US012668964B2

(12) United States Patent
Tashie et al.

(10) Patent No.: US 12,668,964 B2
(45) Date of Patent: Jun. 30, 2026

(54) PASSIVE INFILTRATION DRAINAGE SYSTEM

(71) Applicants: Arik Tashie, Chapel Hill, NC (US); John Mallard, Bahama, NC (US)

(72) Inventors: Arik Tashie, Chapel Hill, NC (US); John Mallard, Bahama, NC (US)

( * ) Notice: Subject to any disclaimer, the term of this patent is extended or adjusted under 35 U.S.C. 154(b) by 163 days.

(21) Appl. No.: 18/632,186

(22) Filed: Apr. 10, 2024

(65) Prior Publication Data

US 2024/0344314 A1 Oct. 17, 2024

Related U.S. Application Data

(60) Provisional application No. 63/458,462, filed on Apr. 11, 2023.

(51) Int. Cl.
*E03F 1/00* (2006.01)
*E02B 11/00* (2006.01)

(52) U.S. Cl.
CPC ..... *E03F 1/002* (2013.01)

(58) Field of Classification Search
CPC ..... E03F 1/002; E02B 11/00; E02B 11/005; E02B 11/02; E02D 3/10; E02D 3/106
See application file for complete search history.

(56) References Cited

U.S. PATENT DOCUMENTS

2012/0269573 A1* 10/2012 Bass, III ..... E01C 3/06 404/2
2017/0167098 A1* 6/2017 des Garennes ..... E02B 11/005
2020/0283324 A1* 9/2020 Filmer ..... C02F 11/14
2021/0274729 A1 9/2021 Russel

FOREIGN PATENT DOCUMENTS

CN 105544696 A * 5/2016 ..... E02B 11/00

* cited by examiner

*Primary Examiner* — Amber R Anderson
*Assistant Examiner* — Stacy N Lawson
(74) *Attorney, Agent, or Firm* — Lindsey Peck; NCCU School of Law IP Clinic

(57) ABSTRACT

A passive infiltration drainage system uses a plurality of conveyance channels and plurality of infiltration tunnels to passively transport water from land surfaces to desired storage areas. The water is either deposited into the deep soil or is passed to a storage basin or outlet point.

14 Claims, 3 Drawing Sheets

PASSIVE INFILTRATION DRAINAGE SYSTEM

CROSS-REFERENCE TO RELATED APPLICATIONS

This application claims the benefit of U.S. Provisional Application No. 63/458,462, filed on Apr. 11, 2023, which is hereby incorporated in its entirety.

FIELD OF THE INVENTION

The present invention is directed at a passive infiltration drainage system configured to allow for drainage of excess water from grassy areas in urban and suburban settings. More particularly, the invention relates to an underground plurality of conveyance channels and a plurality of interconnected infiltration tunnels designed to drain surface water to desired and targeted storage areas.

BACKGROUND OF THE INVENTION

The following description is not an admission that any of the information provided herein is prior art relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply.

In urban and suburban grassy areas like athletic fields and lawns, water pools tend to accumulate following heavy rainfall due to the stripping of organic matter and soil compaction. This prevents surface water from infiltrating, leading to pooling in low-lying areas without proper drainage.

Pooling water can damage grass, building foundations, and create mosquito breeding grounds. It also hinders recreational activities on fields and causes frustration for homeowners in personal yards.

Current drainage systems in urban and suburban areas are largely ineffective as they rely on water to permeate soil to reach drainage channels (e.g., U.S. Patent Application Publication 20210274729 A1). However, compacted soil often prevents water reaching these channels, as capillary forces draw water into fine pore spaces rather than draining into larger pore spaces.

Therefore, there exists a need for a method that can efficiently drain surface water from urban and suburban fields and yards without relying on soil permeation.

SUMMARY OF THE INVENTION

A passive infiltration drainage system is configured for transporting excess water from grassy areas in urban and suburban settings to desired storage areas that comprises a plurality of conveyance channels excavated in the landscape arranged in a network configuration; a plurality of infiltration tunnels excavated in the landscape that are connected to the plurality of conveyance channels configured for receiving and routing water flow; an optional water discharge outlet for collecting water from the plurality of conveyance channels; and bedrock or saprolite connected to the plurality of infiltration tunnels.

In one embodiment, the plurality of conveyance channels comprise sand.

In another embodiment, the plurality of conveyance channels is spaced about three to five feet apart, to a depth of about one to two feet, with a width of about one foot.

In still another embodiment, the plurality of conveyance channels is dug to a depth of about one to two feet.

In yet another embodiment, the plurality of conveyance channels is dug to a width of one foot.

In a further embodiment, the plurality of infiltration tunnels is drilled gradually upslope when adjacent to one or more structures that may be negatively impacted by excess water.

In one embodiment, the plurality of infiltration tunnels is drilled to a radius of 3 inches, and to a depth of 6 feet.

In yet another embodiment, the plurality of infiltration tunnels is drilled directly under impervious surfaces.

In an embodiment, the passive infiltration drainage system further comprises a sediment filter positioned in each of the plurality of conveyance channels, wherein the sediment filter comprises a sand top layer and clay base.

In an embodiment, the sand top layer is about 0.5 mm to 2 mm.

In yet another embodiment, the sand top layer comprises coarse sand and rounded sand.

In another embodiment, the clay is bentonite clay with a sediment size of 0.8 μm to 2000 μm.

In yet another embodiment, the bentonite clay is compacted to a thickness of 1 inch.

In a further embodiment, the conductive hydraulic substrate is saprolite.

In yet another embodiment, the passive infiltration drainage system further comprises an optional water discharge outlet directing collected water into a body of water adjacent to the drainage system.

In one embodiment, a passive infiltration drainage system comprises a plurality of conveyance channels; plurality of infiltration tunnels; bedrock or saprolite; and an optional water discharge outlet; wherein the system is configured to drain water from a land surface to the plurality of conveyance channels; the plurality of conveyance channels are configured to empty the water into the optional water discharge outlet; and the plurality of infiltration tunnels are configured to drain the water to a bedrock or saprolite.

In an embodiment, a method of draining water from a land surface to a desired storage area comprises the steps of draining the water from a land surface to a plurality of conveyance channels; and emptying the water from conveyance channels into an optional water discharge outlet.

In another embodiment, a method of draining water from a land surface to a desired storage area comprises the steps of draining the water from a land surface to a plurality of infiltration tunnels; and emptying the water from infiltration tunnels to a bedrock or saprolite.

DETAILED DESCRIPTION

The present disclosure is directed to a passive infiltration drainage system that drains water from the land surface to a desired storage area, comprising a plurality of conveyance channels, a plurality of infiltration tunnels, bedrock or saprolite, and an optional discharge outlet. The passive infiltration drainage system drains water from the land surface to a network of channels. The excess water is drained via the shallow channels to an optional water discharge outlet or into the bedrock or saprolite via the plurality of infiltration tunnels. The channels are dug 3 to 5 feet apart, to a depth of about 1 to 2 feet, with a width of about 1 foot. The cross-sectional area of the excavated channels is determined by the formula V=A*K (dz/dx), wherein V is the volumetric rate of flow, A is the cross-sectional area of the medium accommodating flow, K is the hydraulic conductivity of the medium, and dz/dx is the slope. The plurality of infiltration tunnels is then drilled to a radius of 3 inches, and to a depth of bedrock or a highly conductive hydraulic substrate. The optional water discharge outlet may be a body of water adjacent to the passive infiltration drainage system.

As used herein, and unless the context dictates otherwise, the term "system" is intended to mean passive infiltration drainage system. Therefore, the terms "system", and "passive infiltration drainage system" are used synonymously.

As used in the description herein and throughout the claims that follow, the meaning of "a," "an," and "the" includes plural reference unless the context clearly dictates otherwise. Also, as used in the description herein, the meaning of "in" includes "into" and "on" unless the context clearly dictates otherwise.

As used herein, the term "about" in conjunction with a numeral refers to a range of that numeral starting from 10% below the absolute value of the numeral to 10% above the absolute value of the numeral, inclusive.

As used herein, and unless the context dictates otherwise, the term "channels" is intended to mean a plurality of excavated channels with a cross-sectional area calculated by the equation: V=A*K (dz/dx) wherein V is the volumetric rate of flow, A is the cross-sectional area of the medium accommodating flow, K is the hydraulic conductivity of the medium, and dz/dx is the slope. This equation, based on Darcy's Law, may be inverted to solve for the required cross-sectional area to accommodate the desired rate of volumetric flow.

As used herein, and unless the context dictates otherwise, the term "sand" is intended to mean a sediment size of about 0.5 mm to 2 mm.

As used herein, and unless the context dictates otherwise, the term "clay" is intended to mean compacted bentonite clay with a sediment size of about 0.8 μm to 2000 μm.

As used herein, and unless the context dictates otherwise, the term "tamper" is intended to mean a tool used to compress or pack material.

Figure 1:
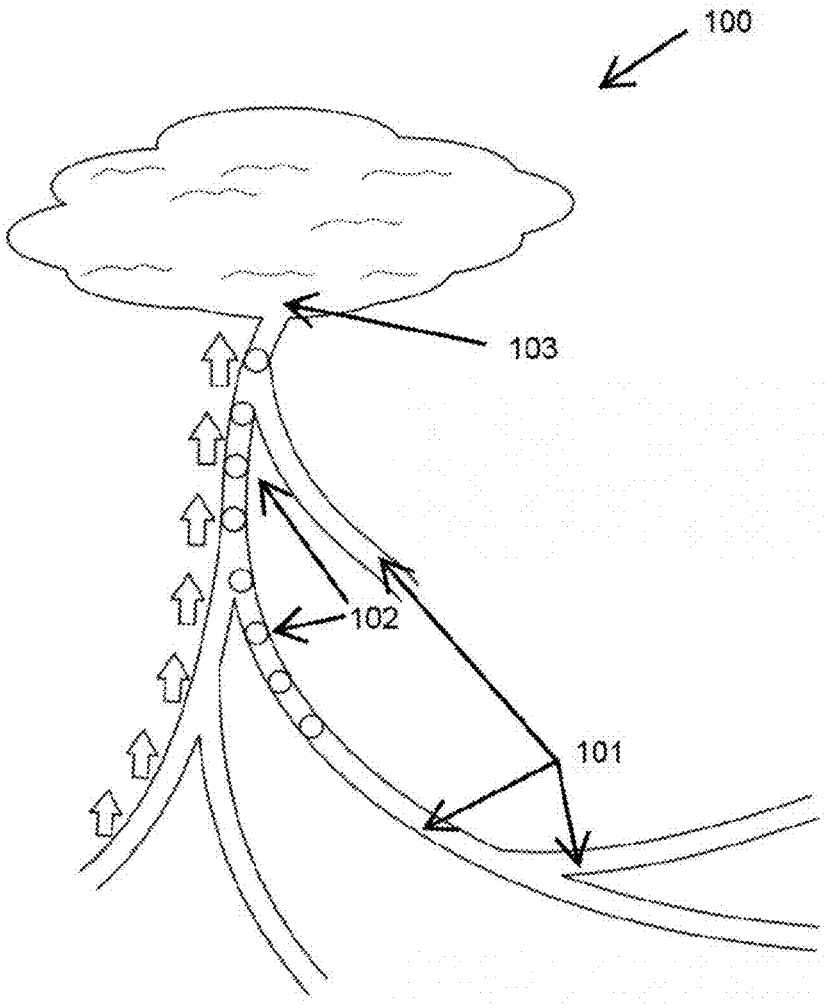
FIG. 1 is an exemplary configuration of a passive infiltration drainage system according to the present invention, which depicts the flow of run-off water through the system.

An exemplary configuration of water drainage through the passive infiltration drainage system 100 is schematically depicted in FIG. 1. In one embodiment, water drains from the ground surface into plurality of conveyance channels 101. Plurality of conveyance channels 101 are excavated in the landscape arranged in a network configuration. In this embodiment, plurality of conveyance channels 101 are dug about 3 to 5 feet apart. In an embodiment, water flows from plurality of conveyance channels 101 to plurality of infiltration tunnels 102, to an optional water discharge outlet 103, adjacent to passage infiltration drainage system 100. In another embodiment, plurality of conveyance channels 101 may be adjusted in diameter based on the size of the landscape or amount of water that needs to be drained. For example, a channel along a steep slope (dz/dx=0.2) may demand a diameter of only 0.25 meters, but farther along the network in a shallower landscape (dz/dx=0.05) the diameter may be increased to 1 meter to accommodate the same volume of flow. In another embodiment, water drains from the ground surface into plurality of infiltration tunnels 102. Plurality of infiltration tunnels 102 are interconnected with plurality of conveyance channels 101 configured for receiving and routing water flow. In this embodiment, plurality of infiltration tunnels 102 are drilled to a radius of 3 inches, and to a depth of 6 feet. In another embodiment, plurality of infiltration tunnels 102 are drilled directly under impervious surfaces. In another embodiment, plurality of infiltration tunnels 102 are drilled gradually upslope when adjacent to one or more structures that may be negatively impacted by excess water.

Figure 2:
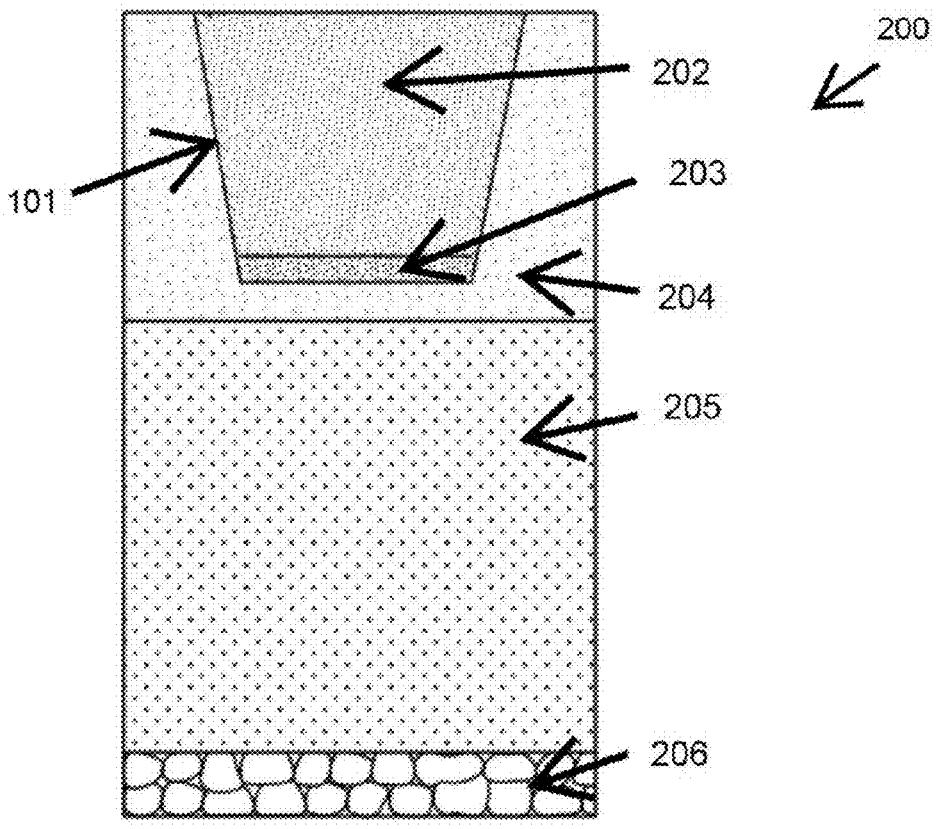
FIG. 2 is an exemplary configuration of a passive infiltration drainage system according to the present invention, which depicts a profile view of an exemplary conveyance channel.

An exemplary configuration for a conveyance channel system 200 is schematically depicted in FIG. 2. In one embodiment, each of plurality of conveyance channels 101 is dug to a depth of about one to two feet with a width of about one foot. In this embodiment, each of plurality of conveyance channels 101 contains sand top layer 202 and clay base 203. In the same embodiment, clay base 203 is created by a one-inch layer of fine clay, poured along the flat bottom surface of plurality of conveyance channels 101. In the same embodiment, clay base 203 is compacted to discourage infiltration of conveyed water along sections of the plurality of conveyance channels 101 where groundwater recharge (or deep percolation of water in the subsurface) is not optimal, for example near a building foundation, a road, or a sidewalk. Because a compacted, tight clay has an effective hydraulic conductivity more than ten orders of magnitude (10,000,000,000×) lower than a well sorted sand, the thin compacted clay layer is effectively impermeable to the downward percolation of water and acts as a barrier to the flow of water in a manner like the addition of a layer of sheet plastic as is commonly used in landscaping.

In another embodiment, the entire volume of the plurality of conveyance channels 101 is filled with coarse sand to create sand top layer 202. In another embodiment, water that flows to passive infiltration drainage system 100 as overland flow (i.e., surface runoff) is infiltrated directly into the plurality of conveyance channels 101 and conveyed laterally through sand top layer 202 at a rate of about 26.7 to 266.7 inches of water per day when placed at a slope of about 2 degrees. Water is preferentially conveyed laterally due to the hydraulic conductivity of the coarse sand exceeding that of the surrounding soils by 6 to 9 orders of magnitude (10^6 to 10^9), thus accommodating water along plurality of conveyance channels 101 even at a shallow slope (e.g., 0.01) at a rate that vastly exceeds the otherwise "natural" downward percolation of the water through the pre-existing substrate or bedrock at unit gradient (slope=1) by several orders of magnitude (10^4 to 10^7 times faster). In another embodiment, rounded sand sediments are selected for sand top layer 202 because this sediment class is resistant to soil compaction allowing water to flow through.

In another embodiment, each of plurality of conveyance channels 101 (comprising high hydraulic conductivity "coarse sand") is dug within a layer of compacted urban soil 204. "Urban soils" are typically comprise clayey and loamy sediments that have been imported and highly compacted by construction equipment, reducing both the relative porosity (ability to hold water) and hydraulic conductivity (ability to convey water) by factors of 2-5 or 1,000 to 1,000,000,000, respectively. Non-compacted deep soils 205 (that are naturally more highly conductive than compacted "urban soils" by 3-9 orders of magnitude) are located below compacted urban soil 204. In this embodiment, non-compacted deep soil 205 continues downward until it reaches bedrock or saprolite 206 that is more hydraulically conductive by 3 to 9 orders of magnitude than the overlying soils, thus allowing the rapid lateral conveyance of excess water off property via the subsurface rather than the ponding of water on property on the less hydraulically conductive surface.

Figure 3:
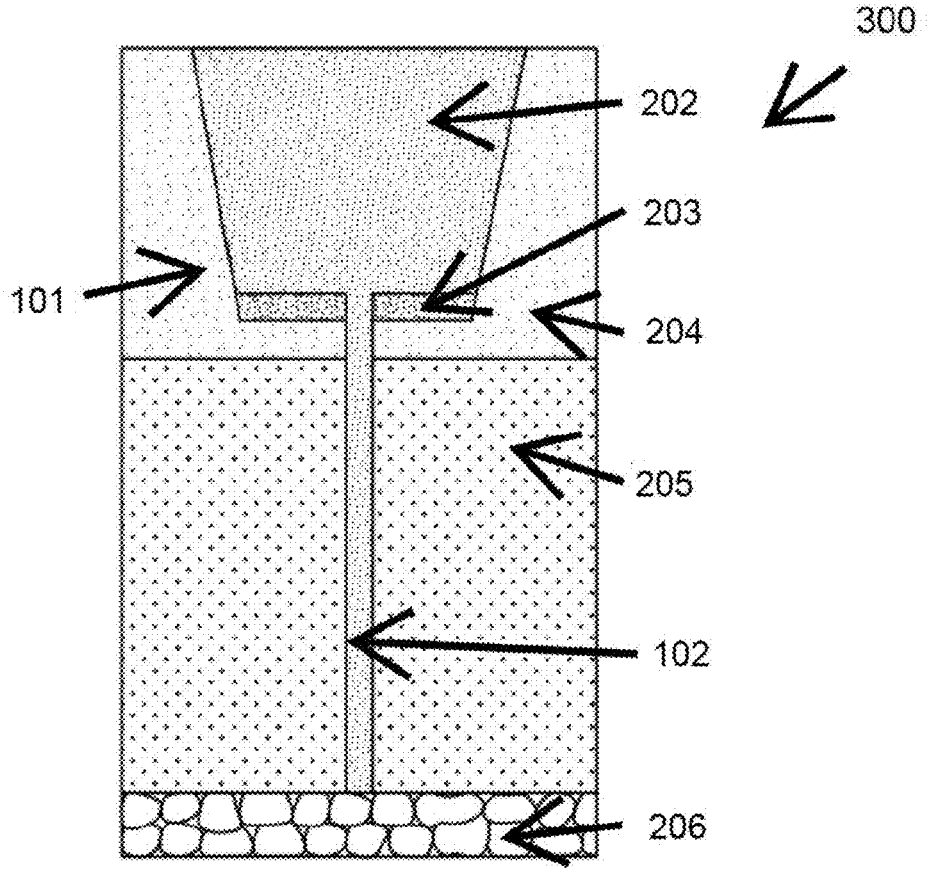
FIG. 3 is an exemplary configuration of a passive infiltration drainage system according to the present invention, which depicts a profile view of an exemplary conveyance channel with an infiltration tunnel bored through it into non-compacted deep soil.

An exemplary configuration for plurality of infiltration tunnels 300 is schematically depicted in FIG. 3. As depicted in FIG. 3, plurality of infiltration tunnel 102 is bored through plurality of conveyance channels 101 in order to allow the percolation of excess water ("Hortonian flow" or "surface runoff") into the deep subsurface so as to recharge local aquifers and provide supplemental water resources to vegetation in desired locations, and to minimize the conveyance of the excess water to otherwise overburdened detentions systems or stream plurality of conveyance channels 101 that are susceptible to intense erosion under conditions of high streamflow volumes. In one embodiment, plurality of infiltration tunnel 102 is drilled with an auger to depth of about six feet, unless the bedrock 206 is less than six feet below ground level. In another embodiment, if bedrock 206 is less than six feet below ground level, plurality of infiltration tunnel 102 is bored to the depth of saprolite 206. In another embodiment, plurality of infiltration tunnel 102 is backfilled with coarse, well-sorted, rounded sand, which allows the water to drain at these locations to a depth of non-compacted deep soil 205. In this embodiment, non-compacted deep soil 205 is not affected by the overlying compaction in compacted urban soil 204.

Thus, specific embodiments for a passive infiltration drainage system and the method of using it have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A passive infiltration drainage system comprising:

a. a plurality of conveyance channels excavated in a landscape parallel to the surface of said landscape, wherein said plurality of conveyance channels are distinct and separated by a different material;

b. a plurality of infiltration tunnels excavated down vertically from said plurality of conveyance channels;

c. an optional water discharge outlet point for collecting water from said plurality of conveyance channels; and d. bedrock or saprolite connected directly to said plurality of infiltration tunnels, wherein:

i. said plurality of conveyance channels are arranged in a network configuration and configured for receiving and routing water flow;

ii. said conveyance channels comprise a top layer and a water-impermeable bottom layer; and iii. said passive infiltration drainage system is configured for transporting excess water from grassy areas in urban and suburban settings to desired storage areas.

2. The passive infiltration drainage system of claim 1, wherein said top layer of said plurality of conveyance channels comprises sand.

3. The passive infiltration drainage system of claim 1, wherein said plurality of conveyance channels are spaced about three to five feet apart.

4. The passive infiltration drainage system of claim 1, wherein said plurality of conveyance channels are dug to a depth of about one to two feet.

5. The passive infiltration drainage system of claim 1, wherein said plurality of conveyance channels are dug to a width of about one foot.

6. The passive infiltration drainage system of claim 1, wherein said plurality of infiltration tunnels are drilled gradually upslope when adjacent to one or more structures that are capable of being negatively impacted by excess water.

7. The passive infiltration drainage system of claim 1, wherein said plurality of infiltration tunnels are drilled to a radius of 3 inches, and to a depth of 6 feet.

8. The passive infiltration drainage system of claim 1, wherein said plurality of infiltration tunnels are drilled directly under impervious surfaces.

9. The passive infiltration drainage system of claim 1, wherein said top layer comprises coarse and rounded sand with a sediment size of about 0.5 mm to 2 mm.

10. The passive infiltration drainage system of claim 1, wherein said water-impermeable bottom layer comprises bentonite clay with a sediment size of about 0.8 μm to 2000 μm.

11. The passive infiltration drainage system of claim 1, where said water-impermeable bottom layer is compacted to a thickness of 1 inch.

12. The passive infiltration drainage system of claim 1, wherein said optional water discharge outlet point is a body of water adjacent to said drainage system.

13. The passive infiltration drainage system of claim 1, wherein:

a. said system is configured to drain water from a land surface to said plurality of conveyance channels;

b. said plurality of conveyance channels are configured to empty said water into said optional water discharge outlet point; and c. said plurality of infiltration tunnels are configured to drain said water to a bedrock or saprolite.

14. A method of draining water from a land surface to a desired storage area, the method comprising the steps of:

a. draining said water from a land surface to a plurality of conveyance channels, wherein:

said plurality of conveyance channels are excavated in a landscape parallel to the surface of said landscape;

said plurality of conveyance channels are distinct and separated by a different material;

said plurality of conveyance channels are arranged in a network configuration and configured for receiving and routing water flow; and a top layer of said plurality of conveyance channels comprises sand;

b. emptying said water from said conveyance channels down to bedrock or saprolite through a plurality of infiltration tunnels, wherein:

said plurality of infiltration tunnels are excavated down vertically from said plurality of conveyance channels;

said bedrock or saprolite is connected directly to said plurality of infiltration tunnels; and said plurality of infiltration tunnels are drilled directly under impervious surfaces; and c. optionally emptying said water from said conveyance channels into a water discharge outlet point.

* * * * *